US006827221B1

(12) United States Patent
Brundiek et al.

(10) Patent No.: US 6,827,221 B1
(45) Date of Patent: Dec. 7, 2004

(54) MILL CLASSIFIER

(75) Inventors: Horst Brundiek, Kaarst (DE); Winfried Ruhkamp, Kaarst (DE)

(73) Assignee: Loesche GmbH (DE)

( * ) Notice: Subject to any disclaimer, the term of this patent is extended or adjusted under 35 U.S.C. 154(b) by 0 days.

(21) Appl. No.: 10/168,845

(22) PCT Filed: May 22, 2000

(86) PCT No.: PCT/EP00/04637

§ 371 (c)(1),
(2), (4) Date: Oct. 1, 2002

(87) PCT Pub. No.: WO01/45849

PCT Pub. Date: Jun. 28, 2001

(30) Foreign Application Priority Data

Dec. 21, 1999 (DE) ..... 199 61 837

(51) Int. Cl.[7] ..... B03D 1/00

(52) U.S. Cl. ..... 209/210; 209/208; 209/724; 209/725

(58) Field of Search ..... 209/208, 210, 209/724, 725

(56) References Cited

U.S. PATENT DOCUMENTS 5,622,321 A * 4/1997 Brundiek et al. ..... 241/79.1

5,624,039 A 4/1997 Folsberg

FOREIGN PATENT DOCUMENTS

| | | |
|---|---|---|
| DE | 38 08 023 A1 | 9/1989 |
| DE | 43 29 662 A1 | 3/1995 |
| DE | 44 23 815 A1 | 4/1997 |
| EP | 0 204 412 B1 | 8/1987 |
| FR | 2 642 994 | 8/1990 |

OTHER PUBLICATIONS

David Salzborn and Arthur Chin–Fatt, "Operational Results Of A Vertical Roller Mill Modified With A High Efficiency Classifier," Record of Conference Papers at the 35th IEEE Cement Industry Technical Conference, May 1993, pp. 329–337.

* cited by examiner

*Primary Examiner*—Donald P. Walsh
*Assistant Examiner*—Kaitlin Joerger
(74) *Attorney, Agent, or Firm*—Ronald A. D'Alessandro; Hoffman, Warnick & D'Alessandro LLC

(57) ABSTRACT

A mill classifier, particularly a roller mill classifier, has a strip rotor and a concentrically arranged guide vane ring with flow-optimized guide vanes and flow channels for a parallel incoming and outgoing flow without constriction or with widening and a diffuser effect. The flow-optimized guide vanes with an incident flow tube with vertical rotation axis and at least one guide plate are arranged adjustably for a tangential to radial incident flow of the strip rotor.

20 Claims, 4 Drawing Sheets

MILL CLASSIFIER

This application claims priority to PCT Application No. PCT/EP00/04637 filed May 22, 2000, which claims the benefit of German Application No. 199 61 837.2 filed Dec. 21, 1999.

The invention relates to a mill classifier, particularly a roller mill classifier according to the preamble of claim 1.

Roller mill classifiers, which can be arranged in integrated manner in or mounted on a roller and bowl mill or in a roller mill, e.g. in an air-swept mill, can be constructed as static or dynamic sifters or classifiers. Combinations of a static and a dynamic classifier, which is then referred to as a high effect classifier, are also known.

A high effect classifier is described in ZKG, vol. 46, 1993, No. 8, pp 444 to 550, FIG. 7. The classifier has a cylindrical strip rotor and a concentrically arranged guide flap or vane ring. The aim is to produce a very effective tangential flow between the static distributor and the strip rotor, so that the coarse particles cannot reach the rotor. The disadvantages are an increased pressure loss and an increasing wear to the guide vanes, particularly with high particle concentrations.

EP 204 412 B1 discloses a mill classifier, which has two superimposed guide vane rings. The guide vanes are adjustably arranged about vertical spindles, the guide vanes of the guide vane rings having independently mounted spindles. Between the guide vane rings is provided a stationary ring and the adjusting devices are located at opposite ends of the guide vanes.

FR 2 642 994 A1 discloses a classifier with a strip rotor and a concentrically arranged guide vane ring. In order to improve classification the guide vanes of the guide vane ring are adjustable about a vertical axis. The rotor strips are constructed in such a way that in each case channels are formed with a cross-section widening from the outside to the inside, so that the centrifugal and resistance forces acting on the particles of a predeterminable size, are in equilibrium over virtually the entire length of the channels. Thus, the equilibrium conditions are obtained via the profile of the rotor strips, the rotor speed and the setting of the guide vanes for different separating diameters.

The cylindrical strip or rod basket rotor used in the afore-mentioned mill classifiers generally has a number of strips, which is at least twice as high as in so-called standard classifiers, which leads to relatively high manufacturing costs. The suspension and mounting of a rod basket rotor also differs from the rotors of the standard classifier and contributes to higher manufacturing and assembly costs.

Figure 5:
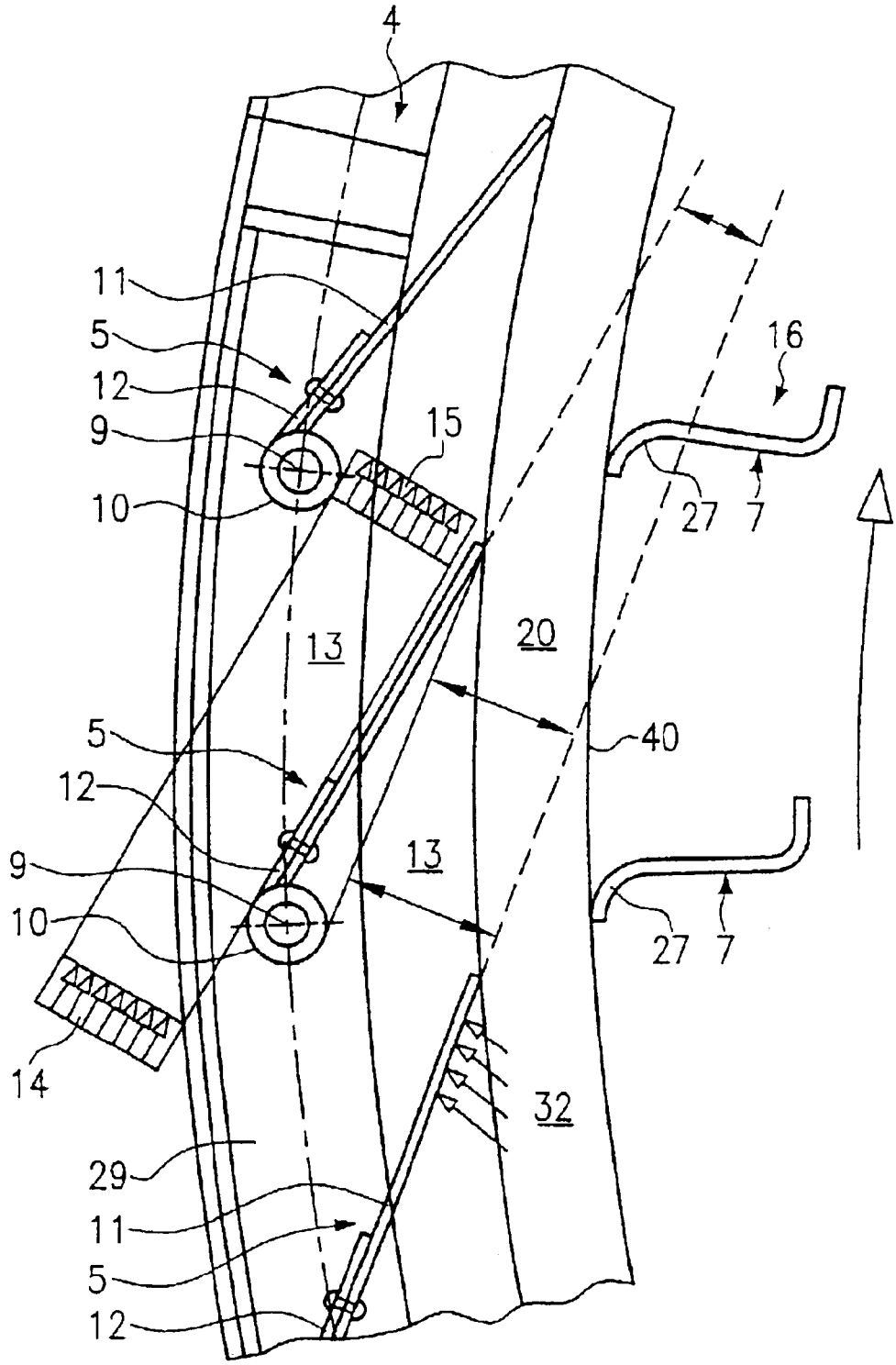

A known standard classifier is the LOESCHE centrifugal/basket classifier of the LKS design (ZKG, vol. 46, 1993, No. 8, p 446, FIG. 5). This dynamic classifier is constructed as a biconical or double cone strip rotor and has a double cone rotor with screwed on classifying strips. The sloping rotor strips correspond to the incident flow from below and lead to a weak deflection of the grinding material-fluid flow. In conjunction with a twisting flow caused by the setting of the blades of a blade ring of the mill and a conically upwardly widening classifier casing, a radial flow occurs at the strip rotor and increases from bottom to top and leading on the conically upwardly widening strip rotor to different centrifugal forces and to a relatively uniform classifying over the entire strip length.

DE 44 23 815 C2 discloses a high effect classifier, in which a static classifying precedes a double cone rotor of a LOESCHE centrifugal/basket classifier. By means of at least two axially superimposed and adjustably arranged guide vane rings and a directional deflection of the grinding material-fluid flow, part of the coarse material is separated, before a dynamic reclassifying takes place through the following conical strip rotor. The classifier has an improved separation efficiency and a lower energy consumption compared with standard classifiers, but does not in all cases meet the constantly increasing demands on efficiency and low manufacturing and maintenance costs.

The object of the invention is to provide a mill classifier, particularly a roller mill classifier, which in the case of particularly simple construction has very low production costs and simultaneously permits a high flexibility and optimization of sifting or classifying processes.

According to the invention the object is achieved by the features of claim 1. Appropriate and advantageous developments appear in the specific description relative to the drawings and in the sub claims.

A fundamental idea of the invention is to retain the advantages of a strip rotor of a LOESCHE centrifugal/basket classifier and to achieve a purely dynamic classifying with the aid of at least one guide vane ring, the guide vanes and the rotor strips being so constructed and mutually oriented that the grinding material particles are not forced onto an orbit outside the strip rotor and are instead delivered into the strip rotor.

According to the invention the guide vanes are shaped and positioned in such a way that there is no so-called cyclone flow, but instead and without an upstream static classifying stage, a grinding material-fluid mixture is directly dynamically classified.

According to the invention a roller mill classifier with a strip rotor of a fundamentally known design and a guide vane ring arranged concentrically around the strip rotor is provided with flow-optimized guide vanes, which are adjustable about a vertical rotation axis and force a grinding material-fluid flow rising from the mill to a tangential to radial incident flow of the rotor strips of the strip rotor.

Preferably use is made of rotor strips, as are known in connection with LKS classifiers, but at least in the vicinity of the guide vanes are arranged vertically and therefore parallel to the guide vanes.

It is appropriate with respect to the production costs and efficient classifying to use as the strip rotor a double cone rotor, particularly of a LKS design LOESCHE centrifugal/basket classifier and to retool or reset the same in such a way that the known rotor strips are retained, but are perpendicular and no longer slope to a cylindrical rotor area. As the rotor strips have a radial dimensioning as with a LKS classifier, it is possible to significantly reduce the number of rotor strips compared with the cylindrical rod basket rotors of the high effect classifier. It has been found that the number of strips can be approximately one third of that of a rod basket classifier and can be max 50%.

A separation-efficient classifying without an upstream static classifying can be achieved by at least one guide vane ring with flow optimized guide vanes, which have a rounded leading edge and at least one guide plate and which are set with respect to the strip rotor in such a way that an imaginary extension of the guide plates does not extend past the strip rotor and instead leads at least tangentially to the outer edges of the rotor strips or radially into the rotor centre.

It is particularly advantageous to have guide vanes with a rounded leading edge and at least one guide plate located thereon in such a way that roughly parallel or widening flow channels are formed between in each case two guide vanes and the incoming and outgoing flows are approximately the same.

In conjuncation with the rounded leading edge there is a parallel flow without constriction during the outgoing flow and as a result of a particularly advantageous streamlined construction of the guide vanes there is an expanding outgoing flow with a diffuser effect, which is linked with a recovery of pressure energy and therefore a reduction of the through-flow resistance of the classifier. However, in the case of planar guide vanes a flow channel with a nozzle effect is formed between two guide vanes.

A cost-effective manufacture, assembly and simple adjustment of the flow-optimized guide vanes can be achieved in that the rounded leading edge is constituted by a cylindrical or tubular incident flow body, e.g. an incident flow tube, on which the guide plate is arranged, e.g. welded tangentially. It is also possible to indirectly fasten the guide plate, e.g. by means of an additional fastening plate to the incident flow tube. Whereas the fastening plate, which can be kept relatively narrow, can be fixed directly to the incident flow tube, the guide plate can be detachably fixed, e.g. screwed to the fastening plate. Thus, if the guide plate wears, a relatively rapid, inexpensive replacement is possible.

Appropriately the incident flow tube is circular cylindrical and made from an abrasion-resistant material, the rotation axis of the guide vanes being formed by the longitudinal axis of the incident flow tube. This leads to the advantage that both the mounting support for the guide vanes, e.g. by means of swivel pins, in the vicinity of the classifier housing, and the adjustment from outside the classifier housing can be performed in an extremely favourable manner.

Streamlined guide vanes are particularly advantageous for flow channels with a diffuser effect and can e.g. be formed by two guide plates, which are tangentially fixed to the incident flow body or tube. It is advantageous for manufacture and mounting if both guide plates have a substantially identical construction and engage on one another with rotor-side edge regions, i.e. taper off. However, the second plate can also be narrower than the guide plate facing the classifying material flow and can be fixed with a different setting angle to the guide plate facing the classifying material flow to the incident flow body, in order to bring about an opening flow channel with diffuser effect.

It has been found that a separation-efficient classifying can be achieved with a strip rotor and at least one guide vane ring having an identical number of rotor strips or guide vanes. In principle, the rotor strips can have a Z-shaped construction.

An advantageous, flow-optimized form of the Z-shaped rotor strips can be achieved if the legs directed towards the guide vanes are rounded. As a result of this rounded Z-shape there is a reduced resistance compared with the conventional angular shape. In addition, the flexural stiffness of the rotor strips is increased, which is particularly advantageous with an overhung arrangement.

In order to achieve a direct dynamic classifying over substantially the entire rotor area, the heights of the guide vanes and the rotor strips are matched to one another. In the case of a strip rotor, which corresponds to a retooled double cone rotor of a LOESCHE centrifugal/basket classifier, the cylindrical rotor area above a conical rotor area is to be dimensioned in such a way that the vertical rotor strips of the cylindrical rotor area have roughly the same height as the concentrically arranged guide vanes of the guide vane ring. The conical rotor area can be made hydraulically ineffective advantageously by means of a cover, e.g. a cover cone, which is located between the cylindrical and the conical rotor area. As the strip rotor with its conical rotor area already functions within the oversize material return cone, there is no need to cover in a jacket-like manner said area or the conical strip ends.

Appropriately for the mill classifier according to the invention not only are the rotor strips of the strip rotor constructed as for a LKS, but also the classifier housing, or at least its upper part, the bearing collet, as well as the drive and driving shaft can be constructed as in a LOESCHE centrifugal/basket classifier. It is advantageous to omit the lower cone of the double cone rotor and to have a shortened construction of the driving shaft. The classifier housing known from the LKS classifier can be fundamentally adopted, but the space for the rising grinding material fluid flow is constricted over the height of the guide vane ring, so that the particle flow is accelerated into the flow channels of the guide vane ring.

The mill classifier according to the invention makes it possible to supply the entire grinding material particles ranging from fine to coarse material, to the strip rotor for a purely dynamic classifying. After passing through the grinding gap between the grinding rolls and the grinding path, the particle flow is centrifuged into the fluid flow, flows upwards as a grinding material-fluid flow along the periphery of the grinding bowl and is transported through the guide vane ring, without prior separation of coarse particles, into the strip rotor. The strip rotor by centrifugal separation separates the coarse particles from the overall particle flow, in that the coarse particles are centrifuged by the strip rotor against the guide vane ends, where they drop by gravity as oversize particles into the coarse material return cone.

It falls within the scope of the invention to provide more than one guide vane ring over the height of the cylindrical rotor area of the strip rotor and to equip the guide vanes of each guide vane ring with an adjusting device. It is advantageous to position a thrust ring below the guide vane ring.

It also falls within the scope of the invention, to use in place of a retooled rotor of a LOESCHE centrifugal/basket classifier, a rod basket classifier of a high effect classifier and to provide same with concentrically arranged, flow-optimized guide vanes according to the present invention.

Essential advantages of the mill classifier according to the invention are relatively low manufacturing, assembly and installation costs due to the possible retooling of a LKS. In addition, through the possible retooling of a LKS, it is rapidly and inexpensively possible to comply with the wishes of customers for a separation-efficient, cost-effective mill classifier.

Figure 1:
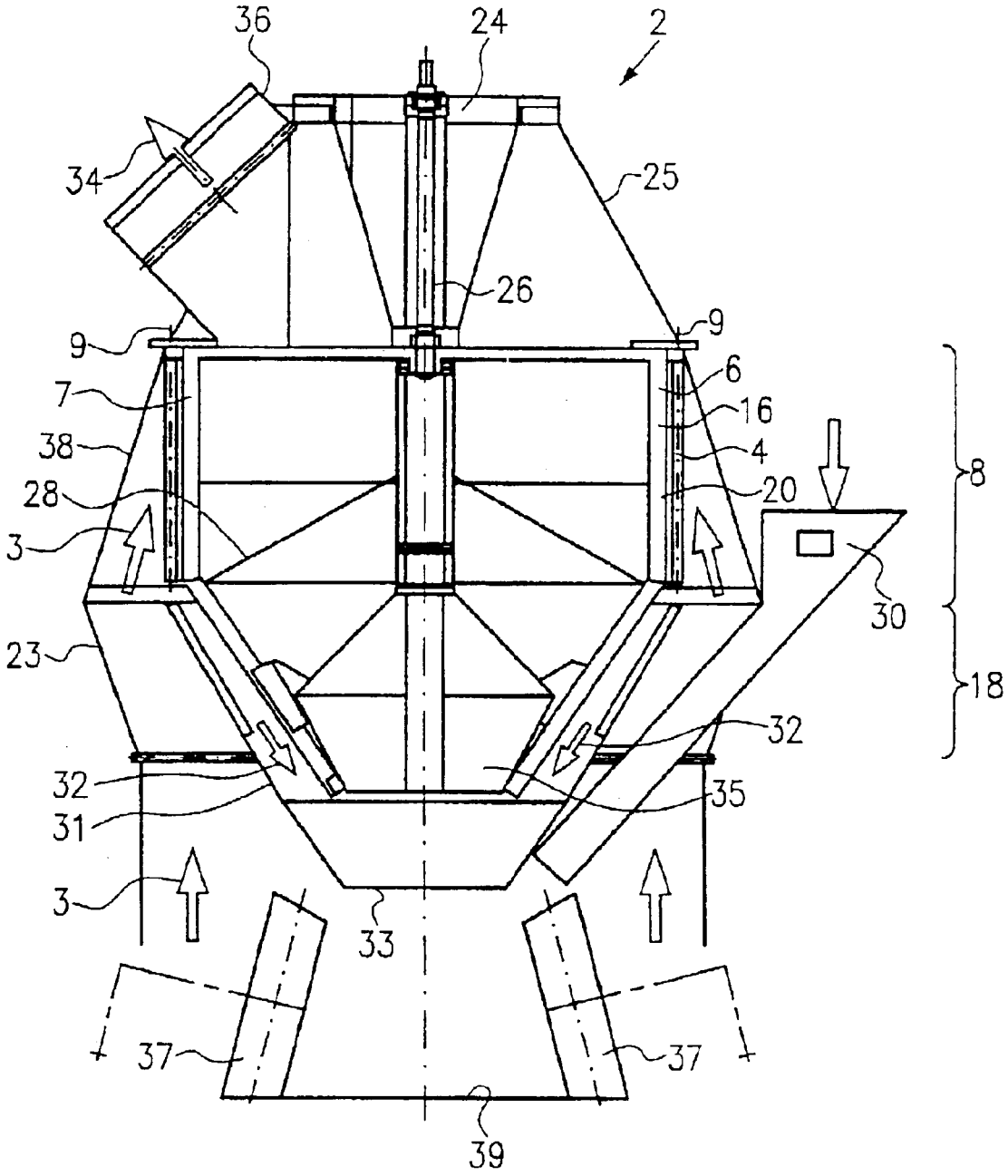
Figure 2:
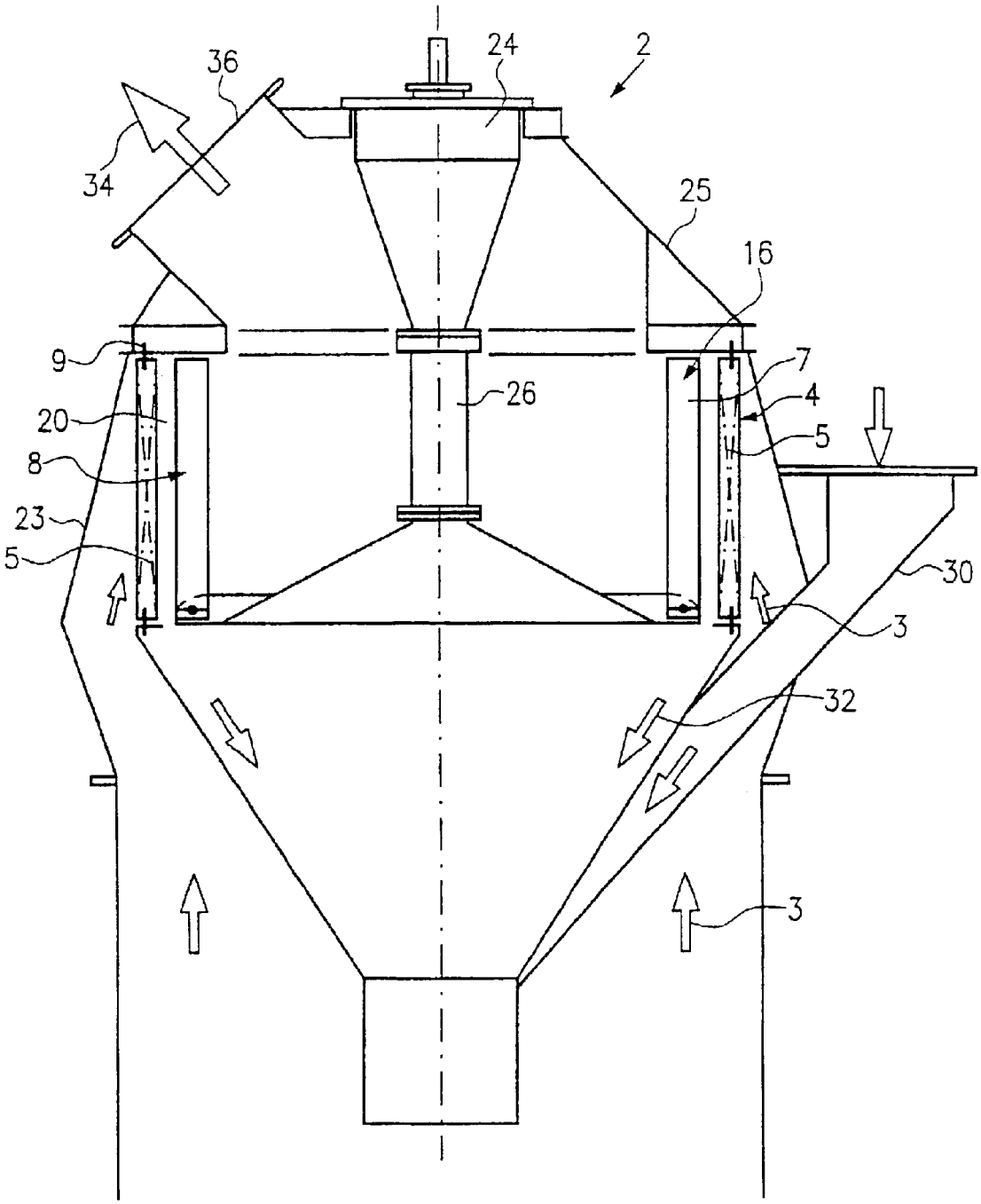
Figure 3:
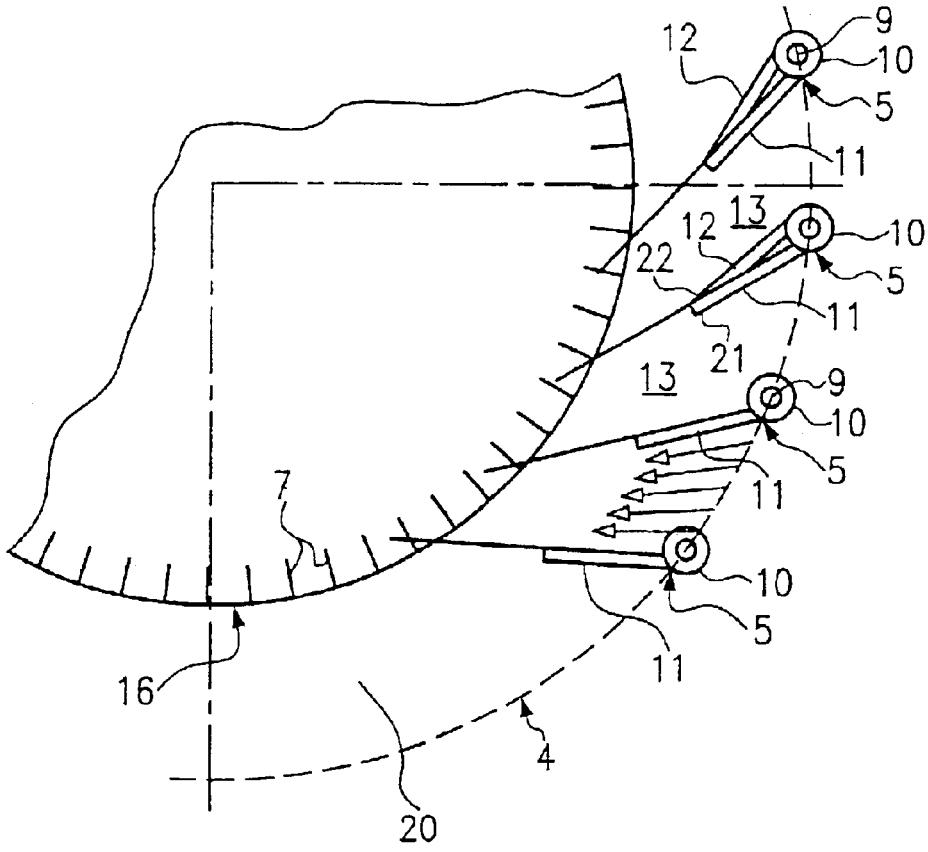
Figure 4:
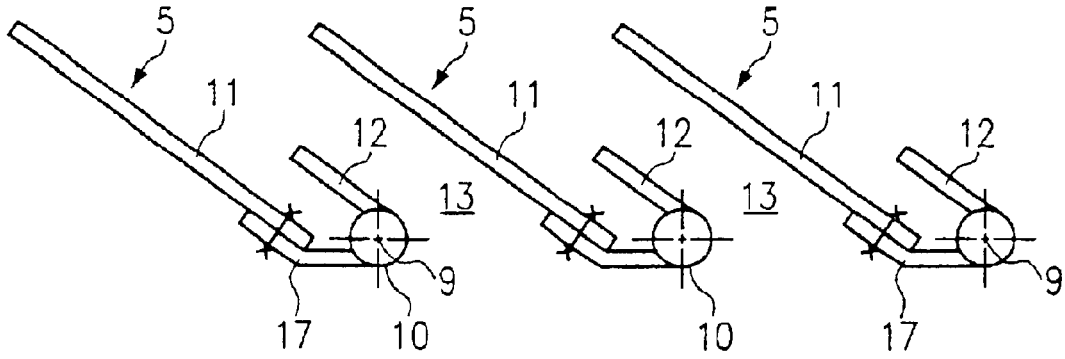

The invention is described in greater detail hereinafter relative to the attached, highly diagrammatic drawings, wherein show:

FIG. 1 a mill classifier according to the invention with a guide vane ring;

FIG. 2 a second variant of a mill classifier according to the invention with a guide vane ring;

FIG. 3 a detail of a strip rotor and on a larger scale guide vanes of a guide vane ring;

FIG. 4 a second variant of guide vanes;

FIG. 5 a highly diagrammatic representation of guide vanes and rotor strips of a strip rotor according to FIGS. 1 and 2.

A mill classifier shown in FIGS. 1 and 2 is a roller mill classifier 2, which can be mounted on a roller mill. The roller mill is intimated by grinding rolls 37 and a grinding path 39.

In a classifier housing 23 with an upper part 25, the roller mill classifier 2 has a dynamic classifier part 6 and a static guide vane ring 4 for an upwardly flowing grinding material-fluid mixture 3. The supply of the feedstock to be ground takes place by means of a feed or delivery tube 30, which is positioned laterally on the classifier housing 23 and extends virtually to a discharge opening 33 of an oversize material cone 31, so that the feedstock together with the oversize material particles rejected by the dynamic classifier part 6, is supplied to a rotating grinding pan 39 and grinding rolls 37.

The dynamic classifier part 6 is constituted by a per se known strip rotor 16 with a cylindrical rotor area 8 and a conical rotor area 18, which with respect to the number and construction, particularly with respect to the radial width of the rotor strip 7 and a bearing collet 24, a superimposed, not shown drive and a driving shaft 26, substantially corresponds to a double cone rotor of a LOESCHE centrifugal/basket classifier. The conical rotor area 18 is rendered ineffective by a facing, which is formed by a cover cone 28 in conjunction with the oversize material cone 31. Whereas in the upper, cylindrical rotor area 8 in conjunction with the flow-optimized guide vanes 5 of the guide vane ring 4 there is a purely dynamic classifying, the sloping classifying strips of the conical rotor area 18 ensure the mechanical connection to the double cone rotor 35.

In principle, the classifier housing 23 and the upper part 25 of said housing 23 have been taken from the LOESCHE centrifugal/basket classifier, i.e. a standard classifier, but the classifier housing 23 in the vicinity of the cylindrical rotor area 8 is tapered or narrowed upwards and a "retracted" housing shape 38 is obtained.

With regards to the classifier housing 23, the mill classifier 2 shown in FIG. 2 corresponds with the exception of the retracted housing shape 38 and with respect to the classifier housing upper part 25, bearing collet 24 and driving shaft 26, as regards both shape and radial extension of the rotor strip 7 to the known LKS standard classifier, but unlike in the classifier according to FIG. 1 has no conical rotor area 18, but instead only a cylindrical rotor area 8 with vertical rotor strip 7 in the narrowing housing 38. There is no longer a double cone 35 as in the case of the mill classifier 2 according to FIG. 1. Coinciding features of the mill classifier 2 according to FIGS. 1 and 2 are given identical reference numerals.

The guide vane ring 4 of the mill classifier 2 in FIGS. 1 and 2 is provided with flow-optimized guide vanes 5, which can be adjusted about a vertical rotation axis 9 (cf. FIGS. 3 to 5). In order to achieve a dynamic classifying of the grinding material-fluid mixture 3 and a separation into coarse material 32 and fine material 34 by rejection at the rotor strip 7 of the strip rotor 16, the guide vanes 5 are BO constructed and arranged that there is no centrifugal flow in a classifying area 20 between the strip rotor 16 and the guide vane ring 4, but instead there is a tangential to radial incident flow of the strip rotor 16 (cf. FIGS. 3 and 5).

FIGS. 3 to 5 shown in exemplified manner flow-optimized guide vanes 5 of the guide vane ring 4. In a first variant in FIG. 3, the guide vanes 5 shown larger than the rotor strip 7 are provided with a rounded leading edge 10 and a guide plate 11, which is fixed directly and tangentially to the rounded leading edge 10. Such guide vanes 5 are shown in FIG. 3 as lower guide vanes, whereas the two upper guide vanes 5 have a streamlined construction and besides the guide plate 11, which faces the grinding material-fluid mixture 3 or the classifying material flow, also has a plate 12, the plate 12, which is remote from the classifying material flow, is also tangentially fixed to the rounded leading edge 10, which is advantageously a circular incident flow tube.

In order to bring about an opening flow channel 13 between two guide vanes 5, the second plate 12 can be fixed with a different setting angle to the guide plate 11 to the leading edge 10. The guide plate 11 and plate 12 of the two upper streamlined guide vanes 5 in FIG. 3 have a substantially identical construction and engage with one another with rotor-side edge areas 21, 22 and therefore taper off. However, streamlined guide vanes 5 are not restricted to this variant.

FIG. 4 shows alternatively constructed guide vanes 5 with an incident flow tube 10, a vertical rotation axis 9 on the longitudinal axis of the incident flow tube 10, with a guide plate 11 and a plate 12. Unlike the guide vanes 5 shown in FIG. 3, the guide plate 11 is not directly fixed to the incident flow tube 10, but is instead detachably fastened thereto by means of an additional fastening plate 17. In this way the wear-exposed guide plate 11 can be replaced. Appropriately both the guide plate 11 and the incident flow tube 10 are made from an abrasion-resistant material or at least partly are provided with an abrasion-resistant coating and/or surface structure. Plate 12 and/or the additional fastening plate 17 can also be given an abrasion-resistant construction. FIG. 4 makes it clear that the setting angle of the indirectly fastened guide plate 11 and/or the plate 12 can be made the same or different, so that either parallel or widening flow channels 13 can be formed and a classifying in accordance with requirements can be obtained.

FIG. 5 shows in exemplified manner two rotor strips 7 of a strip rotor 16. The rotor strips 7 fundamentally have a Z-shaped construction, but at the end thereof facing the guide flap ring 4 have a rounded leg 27, which leads to a reduced resistance and to a higher flexural stiffness. The guide vanes 5 shown in FIG. 5 have as the rounded leading edge 10 and incident flow tube, whose vertical axis forms the rotation axis 9 of the guide vanes 5. The guide vanes 5 are provided with a guide plate 11, which is held indirectly, namely by means of fastening devices, e.g. fastening plates 17, on the incident flow tube 10. Whereas the fastening plates 17 shown in FIG. 4 are angled, for the guide vanes 5 according to FIG. 5 planar fastening plates 17 are used, which are fastened, e.g. welded tangentially to the incident flow tube 10.

The setting of the guide vane ring 4 with respect to the rotor strips 7 provided for the purely dynamic classifying on the part of the mill classifier 2 can be gathered from FIGS. 3 and 5. The guide vanes 5 with guide plates 11 directly or indirectly fastened to the incident flow tube 10 or the streamlined guide vanes 5, e.g. with a guide plate 11 and a plate 12, are so oriented that their imaginary extensions, shown in continuous line form, do not lead past the strip rotor 16 and instead lead tangentially to the outer edges of the rotor strips 7 to radially in the direction of the centre of the strip rotor 16.

In FIGS. 3 and 5 the guide vanes 5 are set at an angle of approximately 60°, so that there is an incident flow of the radially oriented rotor strips 7 and a rejection or repulsion of coarse material particles 32, whereas the fine material particles pass into the strip rotor 16. FIG. 5 shows at the lower guide vane 5 that the coarse material particles 32 are centrifuged towards the guide vane 5 by the Z-shaped rotor strips 7 and in said flow-minimized area drop downwards into the coarse material cone 31 (cf. FIGS. 1 and 2). FIG. 3 and in particular FIG. 5 also illustrate the construction of roughly parallel flow channels 13 with an approximately identical incoming flow 14 and outgoing flow 15 as a result of the flow-optimized guide vanes 5 with guide plates 11 and incident flow body 10. Necessarily in the case of guide vanes without an incident flow body or bodies there is necessarily narrowing flow channels with a nozzle effect during outflow and this is shown by broken lines in FIG. 5. In the parallel flow channels 13 or also in the widening flow channels, where there is an advantageous diffuser effect and a recovery of pressure energy, all the particles of the grinding material-fluid flow from the roller mill, i.e. fine to coarse material, are transported into the strip rotor without prior coarse particles 32 are separated from the rotor 16 by centrifugal separation, in that they are centrifuged against the guide vanes 5, i.e. against the armoured guide plates 11 or plates 12 (cf. FIGS. 3 to 5). By gravity the coarse material particles 32 in the classifying area 20 drop as oversize material into the oversize material cone 31 and are returned to the grinding path.

What is claimed is:

1. A roller mill classifier, comprising:

a guide vane ring for a rising grinding material-fluid flow, wherein the guide vane ring includes guide vanes that are adjustable about vertical rotation axes;

a dynamic classifier part comprising a strip rotor having a cylindrical rotor area and rotor strips that are concentrically surrounded by the guide vanes;

a classifying area, formed in the cylindrical rotor area;

wherein the guide vanes of the guide vane ring have a flow-optimized shape having a rounded leading edge and at least one guide plate;

wherein the guide vanes are adjustable between a direction tangential and a direction radial to the cylindrical rotor area;

wherein the strip rotor comprises a double cone rotor of a centrifugal classifier having inclined rotor strips in a lower cone and being retooled such that the rotor strips are vertically arranged to a cylindrical rotor area; and wherein the strip rotor includes a conical rotor area that is made hydraulically ineffective.

2. A roller mill classifier, comprising:

a guide vane ring for a rising grinding material-fluid flow, wherein the guide vane ring includes guide vanes that are adjustable about vertical rotation axes;

a dynamic classifier part comprising a strip rotor having rotor strips that are concentrically surrounded by the guide vanes;

wherein the guide vane ring and the dynamic classifier part form a classifying area;

wherein the strip rotor is at least zonally cylindrically constructed and includes a cylindrical rotor area having vertical rotor strips;

wherein the guide vanes of the guide vane ring comprise a flow-optimized shape and are adjustable between a tangential and radial incident flow of the cylindrical rotor area;

wherein the guide vanes include a rounded leading edge and at least one guide plate;

wherein the vertical rotation axis of each guide vane is formed in the rounded leading edge; and wherein a first guide vane and an adjacent guide vane form a flow channel having a diffuser effect that comprises at least one of a parallel flow channel and a widening flow channel.

3. The mill classifier of claim 2 wherein a fist guide vane and an adjacent guide vane form a flow channel having a diffuser effect, the flow channel being one of substantially parallel and widening.

4. The mill classifier of claim 3, wherein the rounded leading edge of each guide vane comprises an incident flow body that includes an incident flow tube, and wherein the guide plate is arranged directly and tangentially at the incident flow tube.

5. The mill classifier of claim 4, wherein the guide plate is attached to the incident flow tube using a fastening plate.

6. The mill classifier of claim 4, wherein the incident flow tube comprises a circular cylindrical construction, and wherein the rotation axis of each guide vane is formed by the longitudinal axis of the incident flow tube.

7. The mill classifier of claim 4, wherein the guide vanes comprise a streamlined construction, and wherein a further plate is arranged tangentially to the incident flow tube.

8. The mill classifier of claim 7, wherein the further plate is substantially similar to the guide plate.

9. The mill classifier of claim 7, wherein the flow channel widens, and wherein the fixer plate is located at the incident flow tube and has a different setting angle than the guide plate.

10. The mill classifier of claim 7, wherein the guide plate and the further plate nearly engage rotor-side edge areas.

11. The mill classifier of claim 2, wherein a guide plate that faces coarse material particles from the dynamic classifier part at least partially comprises one of a wear-resistant material and a wear-resistant coating.

12. The mill classifier of claim 2, wherein the rotor strips comprise a z-shaped construction, and wherein a guide vane side of each rotor strip has a rounded leg.

13. The mill classifier of claim 2, wherein the strip rotor comprises a double cone rotor of a centrifugal classifier having inclined rotor strips in a lower cone and being retooled such that the rotor strips are vertically arranged to the cylindrical rotor area, and wherein the strip rotor includes a conical rotor area that is made hydraulically ineffective.

14. The mill classifier of claim 13, wherein the double cone rotor includes rotor strips that are substantially vertical above the conical rotor area and form the cylindrical rotor area, and wherein the conical rotor area is covered by a cover cone.

15. The mill classifier of claim 13, wherein the rotor strips of the cylindrical rotor area and for a cylindrical envelope coaxial to the guide vane ring, have a height corresponding to a height of the guide vanes of the static classifier.

16. The mill classifier of claim 13, wherein the classifier comprises:

a classifier housing upper part;

a bearing collet;

a drive positioned above the bearing collet;

a driving shaft; and a classifier housing conically tapering over a height of the guide vane ring.

17. The mill classifier of claim 2, wherein the strip rotor comprises a rod basket classifier rotor having vertical rotor strips.

18. A roller mill classifier, comprising:

a guide vane ring for a rising grinding material-fluid flow, wherein the guide vane ring includes guide vanes that are adjustable about vertical rotation axes;

a dynamic classifier part comprising a strip rotor having a cylindrical rotor area and rotor strips that are concentrically surrounded by the guide vanes;

a classifying area, formed in the cylindrical rotor area;

wherein the guide vanes of the guide vane ring have a flow-optimized shape having a rounded leading edge and at least one guide plate;

wherein the guide vanes are adjustable between a direction tangential and a direction radial to the cylindrical rotor area;

wherein the rotor strips comprise a z-shaped construction; and wherein a guide vane side of each rotor strip has a rounded leg.

19. The mill classifier of claim 18, wherein the guide vanes have a rotation axis that is formed in the vicinity of the rounded leading edge, and wherein a first guide vane and an adjacent guide vane form a flow channel having a diffuser effect, the flow channel being one of substantially parallel and widening.

20. The mill classifier of claim 18, wherein the strip rotor comprises a double cone rotor of a centrifugal classifier having inclined rotor strips in a lower cone and being retooled such that the rotor strips are vertically arranged to a cylindrical rotor area, and wherein the strip rotor includes a conical rotor area that is made hydraulically ineffective.

* * * * *

UNITED STATES PATENT AND TRADEMARK OFFICE

CERTIFICATE OF CORRECTION

PATENT NO. : 6,827,221 B1
DATED : December 7, 2004
INVENTOR(S) : Brundiek et al.

It is certified that error appears in the above-identified patent and that said Letters Patent is hereby corrected as shown below:

Column 7,
Line 61, delete “fist” and insert -- first --.

Signed and Sealed this

First Day of March, 2005

JON W. DUDAS
*Director of the United States Patent and Trademark Office*